US005659837A

United States Patent [19]

Jo

[11] Patent Number: 5,659,837

[45] Date of Patent: Aug. 19, 1997

[54] DEVELOPING DEVICE FOR USE IN IMAGE FORMING APPARATUS

[75] Inventor: Hae-seog Jo, Suwon, Rep. of Korea

[73] Assignee: SamSung Electronics Co., Ltd., Suwon, Rep. of Korea

[21] Appl. No.: 554,367

[22] Filed: Nov. 8, 1995

[30] Foreign Application Priority Data

Nov. 8, 1994 [KR] Rep. of Korea ..... 1994-29180

[51] Int. Cl.[6] ..... G03G 15/00

[52] U.S. Cl. ..... 399/25; 399/27; 399/111

[58] Field of Search ..... 355/210, 203–207, 355/260, 200; 74/1.5, 813 L; 399/24, 25

[56] References Cited

U.S. PATENT DOCUMENTS

| | | | |
|---|---|---|---|
| 2,845,145 | 7/1958 | Lee | 74/813 L |
| 5,196,884 | 3/1993 | Sugiyama et al. | 355/200 |
| 5,229,824 | 7/1993 | Tsusaka et al. | 355/260 |
| 5,268,722 | 12/1993 | Ikkatai et al. | 355/260 |
| 5,289,243 | 2/1994 | Sakamoto | 355/260 |
| 5,300,991 | 4/1994 | Hiraike | 355/260 |
| 5,398,098 | 3/1995 | Fukunaga et al. | 355/200 |
| 5,430,531 | 7/1995 | Kamiya | 355/260 |
| 5,508,795 | 4/1996 | Kikuchi | 355/260 |

*Primary Examiner*—Arthur T. Grimley
*Assistant Examiner*—Quana Grainger
*Attorney, Agent, or Firm*—Robert E. Bushnell, Esq.

[57] ABSTRACT

A developing device in an image forming apparatus having a cartridge loading portion for loading a replaceable toner cartridge, a frame including a hollow portion for receiving a developer supplied from the cartridge, a photosensitive drum installed in the hollow portion and having a surface exposed to the exterior of the frame, and a developer roller installed adjacent to the photosensitive drum, the developing device having a cartridge control device installed on the one side of the cartridge loading portion to control the installation and removal of the toner cartridge, in which the cartridge control device includes a cartridge installation and removal device for allowing a user to install or remove the toner cartridge, a counter for counting the number of toner cartridge replacements, and a cartridge removal protector for prohibiting removal of the toner cartridge from the developing device when a predetermined number of toner cartridge replacements is reached so as to prevent contamination resulted from an imbalance between the total amount of the toner supplied and the capacity of a waste toner container.

24 Claims, 5 Drawing Sheets

DEVELOPING DEVICE FOR USE IN IMAGE FORMING APPARATUS

CROSS-REFERENCE TO RELATED APPLICATIONS

This application makes reference to, incorporates the same herein, and claims all benefits accruing under 35 U.S.C. §119 from an application for Developing Device For Use In Image Forming Apparatus earlier filed in the Korean Industrial Property Office on 8 Nov. 1994 and assigned Ser. No. 1994/29180.

BACKGROUND OF THE INVENTION

1. Technical Field

The present invention relates to a developing device for use in an image forming apparatus, and more particularly, to a developing device for use in an image forming apparatus having a toner cartridge control device capable of controlling the number of replacement times of a toner cartridge relative to the developing device.

2. Background Art

In an image forming apparatus such as, for example, a copier, a printer, an a facsimile machine or other image creation mechanism using an electrophotographic process, a latent image formed on a photosensitive drum (i.e., photo sensitometer) is developed by applying toner from a developing unit onto the photosensitive drum. The developed image is then transferred and fixed onto a sheet of paper. It is common that a replaceable tone cartridge is used to supply toner to the developing unit. During the fixing of each image onto the sheet of paper however, the residue of the toner remains on a surface of the photosensitive drum. Therefore, the residue or waste toner remaining on the photosensitive drum must be collected after cleaning before the photosensitive drum prepares for a next image forming operation.

Generally, there are three conventional processes for collecting and handling residue toner in an image forming apparatus. The first residue toner collection process involves the collection of the residue toner in a container that has to be manually handled. In doing so, the container for storing residue or waste toner has to be specially handled in consideration of environmental conservation. Furthermore, the user must guard against contamination of the interior of the image forming apparatus. That is, unless the user faithfully replaces the container periodically in accordance with a prearranged exchange cycle, generally determined by the manufacturer and based on the size of the container, the residue toner collected by the container overflows from the container and contaminates the interior of the image forming apparatus.

The second residue toner collection process requires the image forming apparatus to circulate by way of electromagnetic and reuse the residue toner. This second method however requires a complex collection device to collect and reuse the residue toner, which imposes undesirable additional costs on the product.

The third process allows the user to keep the collected residue toner inside the developing device, either by using a disposable developing device (called a single cartridge method) or by reusing the same developing device until it wears out, while replenishing the developing device with toner (called a refill cartridge method). In other words, an image forming apparatus is initially provided, e.g., by the manufacturer, with the toner cartridge having toner of a sufficient quantity, or with the toner cartridge having toner that may be replenished by the user on an as-needed basis.

Most conventional image forming apparatuses available in the market adopt the third process for keeping the collected residue toner inside the developing device such as, for example, mentioned U.S. Pat. No. 5,289,243 for Installation And Removal Structure Of A Developing Unit And A Toner Cartridge In An Image Forming Apparatus issued to Sakamoto and U.S. Pat. No. 5,268,722 for Detachable Developer Supply Container Having Means For Selectively Prohibiting Detachment issued to Ikkatai et al. In these conventional apparatuses a toner cartridge is replaced while in the developing unit, and the service life of the developing device must be determined according to the service life of the toner cartridge used and the volume of a storage reservoir collecting residue toner after each image formation operation. Otherwise, the residue toner collected in the storage reservoir may leak out from the reservoir and contaminate the interior of the image forming apparatus.

In order to attempt to prevent leakage of the residue toner collected in the storage reservoir that may contaminate the interior of the image forming apparatus, U.S. Pat. No. 5,229,824 for Developer Material Supplying Device For Integral Type Processing Unit Assembled In Electrophotophic Type Image Recording Apparatus issued to Tsusaka et al. employs a counter in a developing unit for counting the number of replacement times of a toner cartridge so that the user can acknowledge the replacement timing of the developing unit and the storage reservoir. In this construction it is however, difficult to consistently monitor the counter and memorize the exchange cycle of the toner cartridge. Tsusaka '824 uses a toner cartridge limiting mechanism fixed to a developing unit having a movable segment in which, upon application of force by the user, the mechanism allows the user to replace of toner cartridge a fixed number of times. While the toner cartridge limiting mechanism of Tsusaka '824 limits the replacement times of the toner cartridges in an effort to avoid overflow of residue toner contained in the storage reservoir, it has been my observation that the Tsusaka mechanism is readily susceptible to a user's frequent mistake in that if excessive force is applied to the movable segment by accident, for example, the toner cartridge limiting mechanism would fail to allow further toner cartridge replacement even when the storage reservoir is still capable of collecting residue toner from additional toner cartridges without having an overflow or leakage.

SUMMARY OF THE INVENTION

Accordingly, it is therefore an object of the present invention to provide an improved image forming apparatus.

It is another object to provide a toner cartridge control device capable of limiting the number of replacement times of a toner cartridge in a developing unit so as to avoid an overflow of residue toner collected in a reservoir container.

It is also an object of the present invention to provide a developing unit in an image forming apparatus having a toner cartridge control device able to simply and accurately control the number of replacement times of a toner cartridge so as to prevent imbalance between the total amount of the toner supplied by the detachable toner cartridge and the capacity of the reservoir container for collecting residue toner.

It is a further object of the present invention to provide a toner cartridge control device in which the number of times that a toner cartridge can be replaced may be reliably controlled in relation to the service life of developing unit and the reservoir container.

These and other objects may be achieved with a developing device in an image forming apparatus having a cartridge loading portion for loading a toner cartridge, a frame including a hollow portion for receiving toner supplied from the toner cartridge, a photosensitive drum installed in the hollow portion with a photosensitive surface of the photosensitive drum exposed to the exterior of the frame, and a developer roller installed adjacent to the photosensitive drum. The developing device uses a cartridge control device installed on the frame adjacent to the cartridge loading portion for controlling the installation and removal of the replaceable toner cartridge based upon a number of toner cartridge replacements. The cartridge control device has a cartridge installation and removal device for allowing a user to install the replaceable toner cartridge on the developing device and to remove the replaceable toner cartridge from the developing device; a counter set to make a count of the number of toner cartridge replacements; and a cartridge removal protector prohibiting removal of the replaceable toner cartridge from the developing device when the number of toner cartridge replacements reaches a predetermined count value.

Accordingly, the cartridge control device of the present invention effectively limits the number of replacement times of the toner cartridge after the toner cartridge has been replaced for a fixed number of times in order to prevent contamination of the image forming apparatus resulted from an overflow of residue toner collected in a reservoir storage.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
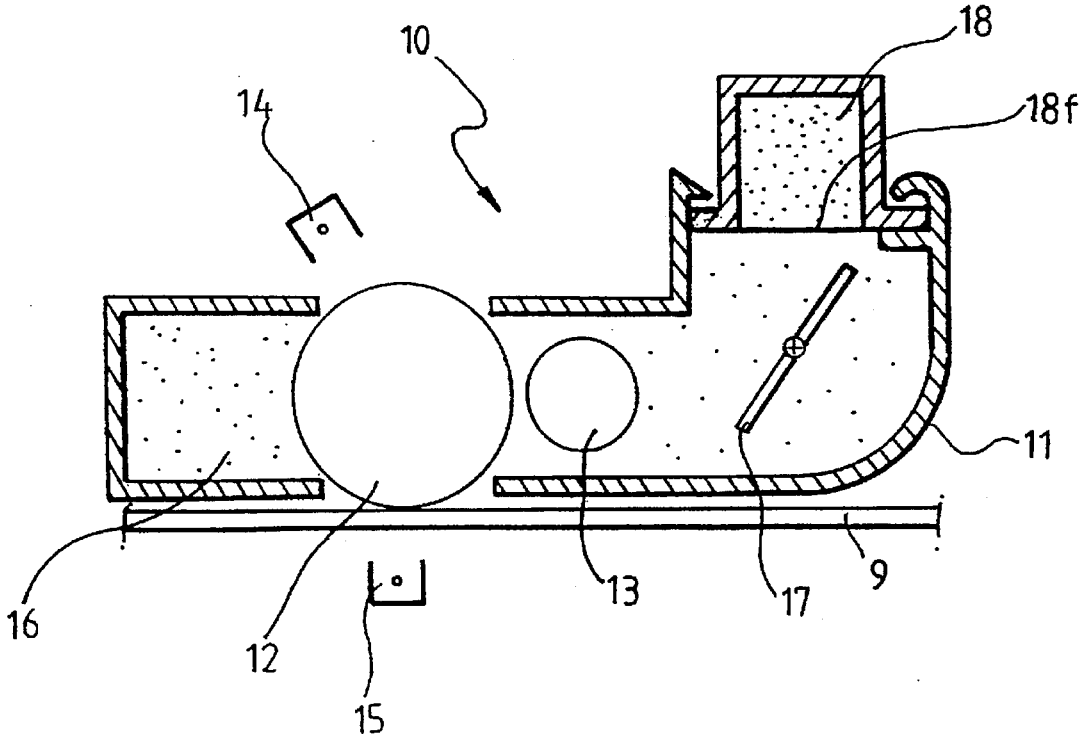
FIG. 1 (PRIOR ART)
FIG. 1 is a cross-sectional view of a developing device in a conventional image forming apparatus.

Referring now to the drawings and particularly to FIG. 1 which illustrates a conventional developing device for use in an image forming apparatus. As shown in FIG. 1, the conventional developing device 10 generally includes a frame 11, a detachable toner cartridge 18 loaded on a loading portion of the frame 11 for supplying toner when a sealing film **18*f* is removed, an agitator 17 for dispersing the toner within the frame 11, a developer roller 13, a photosensitive drum 12 for serving as a latent image carder to form a latent image on a sheet of paper as guided by a paper guide 9, a charger device 14 for charging the photosensitive drum 12, a transfer device 15 for enabling toner to be transferred to the photosensitive drum 12 to develop the latent image, and a storage reservoir 16 for collecting the residue toner that has been scraped from a surface of the photosensitive drum 12** by a cleaning unit (not shown).

In such a developing device as constructed above, the service life of the developing device is determined according to the service life of the detachable toner cartridge and the volume of the storage reservoir. For example, supposing that the developing device has a service life capable of performing six thousand complete times image forming operations corresponding to six thousand sheets of recording paper and that each detachable toner cartridge has a service life of three thousand sheets of paper, the user can replace the toner cartridge twice (assuming a developer-filled cartridge is initially provided in the apparatus when purchased), during which time the residue toner is safely collected in storage reservoir 16. If the user replaces the detachable toner cartridge more than two times however, the residue toner may overflow and contaminate the interior of the image forming apparatus. Thus, such conventional developing device is not capable of controlling the number of replacement times of a toner cartridge 18 so that the residue toner collected in the storage reservoir 16 does not overflow and contaminate the image forming process.

Figure 2:
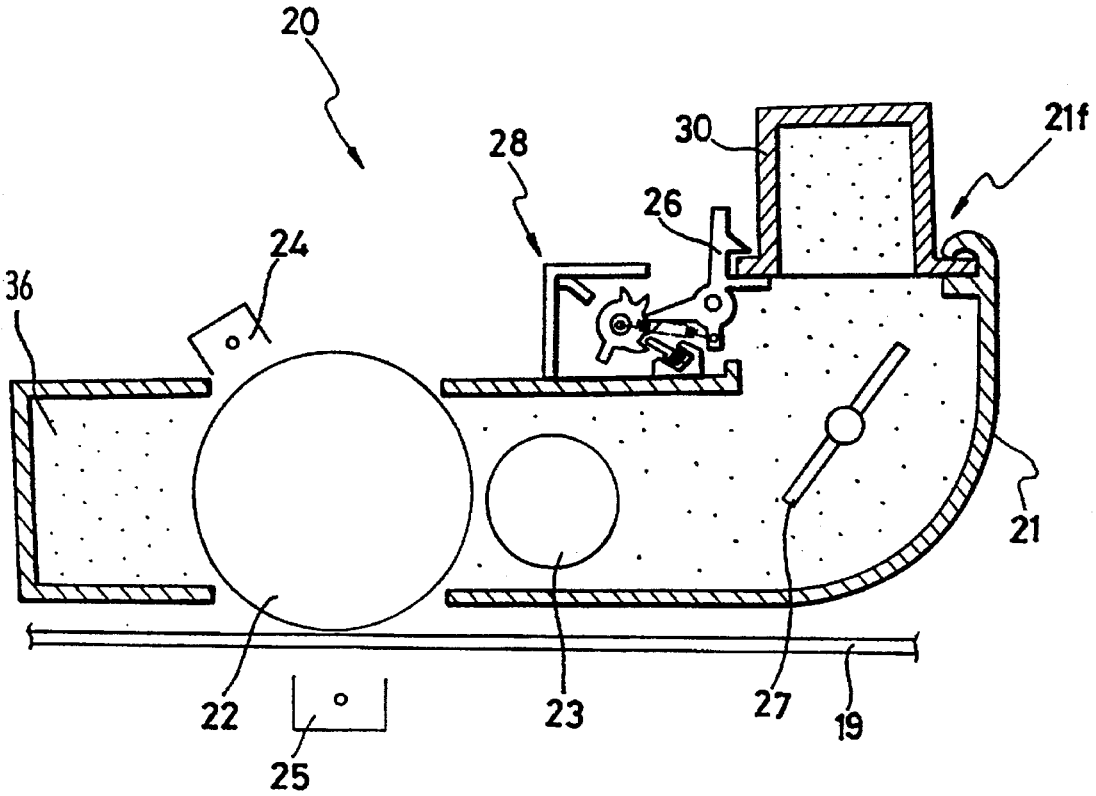
FIG. 2 is a cross-sectional view of a developing device in an image forming apparatus constructed according to the principles of the present invention.

Turning now to FIG. 2 which illustrates a developing device 20 in an image forming apparatus as constructed according to the principles of the present invention, the developing device 20 includes a frame 21 having a loading potion **21*f* accommodating a detachable toner cartridge 30, a photosensitive drum 22 forming a latent image on a sheet of paper as the sheet of paper is being supported by a paper guide 19, a developing roller 23 transporting toner onto the photosensitive drum 22, a charging device 24 charging the photosensitive drum 22 in order to form the latent image, a transferring device 25, a storage reservoir 36 collecting the residue toner that has been scraped from a surface of the photosensitive drum 22, and an agitator 27 uniformly distributing toner within the frame 21 supplied from the detachable toner cartridge 30 installed on the loading portion 21*f* of the frame 21. Adjacent to the loading portion 21*f* of the frame 21 is a cartridge control device 28 fixed to the frame 21 for controlling attachment and detachment of the toner cartridge 30**.

Figure 3:
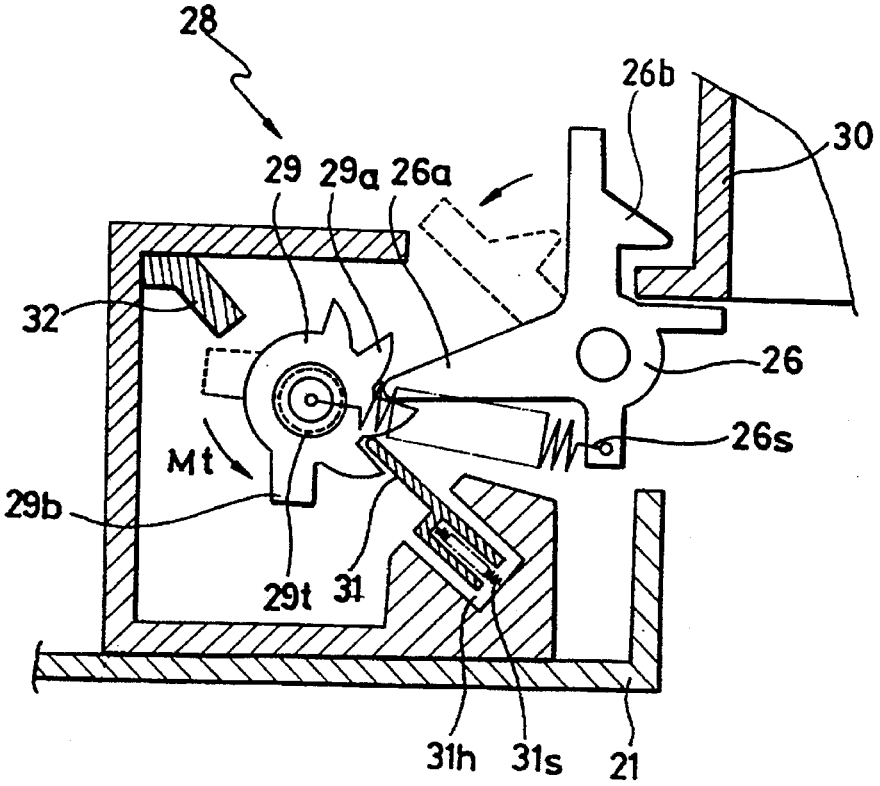
FIG. 3 is a cross-sectional view of a cartridge control device in the developing device as shown in FIG. 2.

FIG. 3 illustrates one embodiment of cartridge control device 28 as constructed according to the principles of the present invention. The cartridge control device 28 generally includes a cartridge attachment and detachment device for allowing the user to install a new toner cartridge on the loading portion **21*f* of the developing device 20 for supplying toner and to remove the empty toner cartridge from the loading portion 21*f* of the developing device 20**, a counter for counting the number of replacement times of the toner cartridge, and a cartridge detachment protector for preventing detachment of the toner cartridge when the count value of the counter reaches a predetermined value.

The cartridge attachment and detachment device is in a form of a rotary lever 26 capable of rotating in a first direction while being elastically biased in a second direction opposite of the first direction. The rotary lever 26 has a lock **26*b* at one arm for locking the toner cartridge 30** to the frame 21 over the loading portion 21*f* of the developing device 20, and a mediator 26*a* at another arm extending from the lock 26*b* by a predetermined angular interval.

The counter is in a form of a rotating cam 29 having a plurality of teeth 29*a* mediated by mediator 26*a* for being elastically biased in the first direction to rotate in the second direction, and a reverse rotation prevention portion 31 for preventing the rotating cam 29 from rotating in the first direction.

The cartridge detachment protector is in a form of a protrusion 29*b* formed on the rotating cam 29 followed the teeth 29*a* by a predetermined angular interval, and a stopper 32 secured to the bracket frame for stopping the protrusion 29*b* of the rotating cam 29 from rotating after the count value of the counter reaches the predetermined value in order to prevent removal of the toner cartridge 30 mounted on the loading portion 21*f* of the developing device 20.

Meanwhile, the rotating cam 29 includes a torsion spring 29*t* for providing movement in the fast direction (i.e., a counterclockwise moment in the view shown by FIG. 3) for enabling the rotating cam 29 to lock firmly against the reverse rotation prevention portion 31 after each time the rotating cam 29 is being rotated in the second direction by way of the rotary lever 26. The reverse rotation prevention portion 31 includes a compression spring 31*s* for supplying elastic bias so that the reverse rotation prevention portion 31 is able to flexibly slide along each tooth 29*a* of the rotating cam 29, as the rotary lever 26 forces the rotating cam 29 to rotate in the second direction by way of the mediator 26*a*, and to lock in each tooth after each rotation is completed so as to prevent the rotating cam 29 from rotating in the fast direction. The rotary lever 26 and the rotating cam 29 are elastically connected under the tension of a pulling spring 26*s* so that after each rotation of the rotary lever 26, by application of force by the user, the rotary lever 26 is restored to an original position and the rotating cam 29 is firmly stopped by the reverse rotation prevention portion 31.

Figure 4:
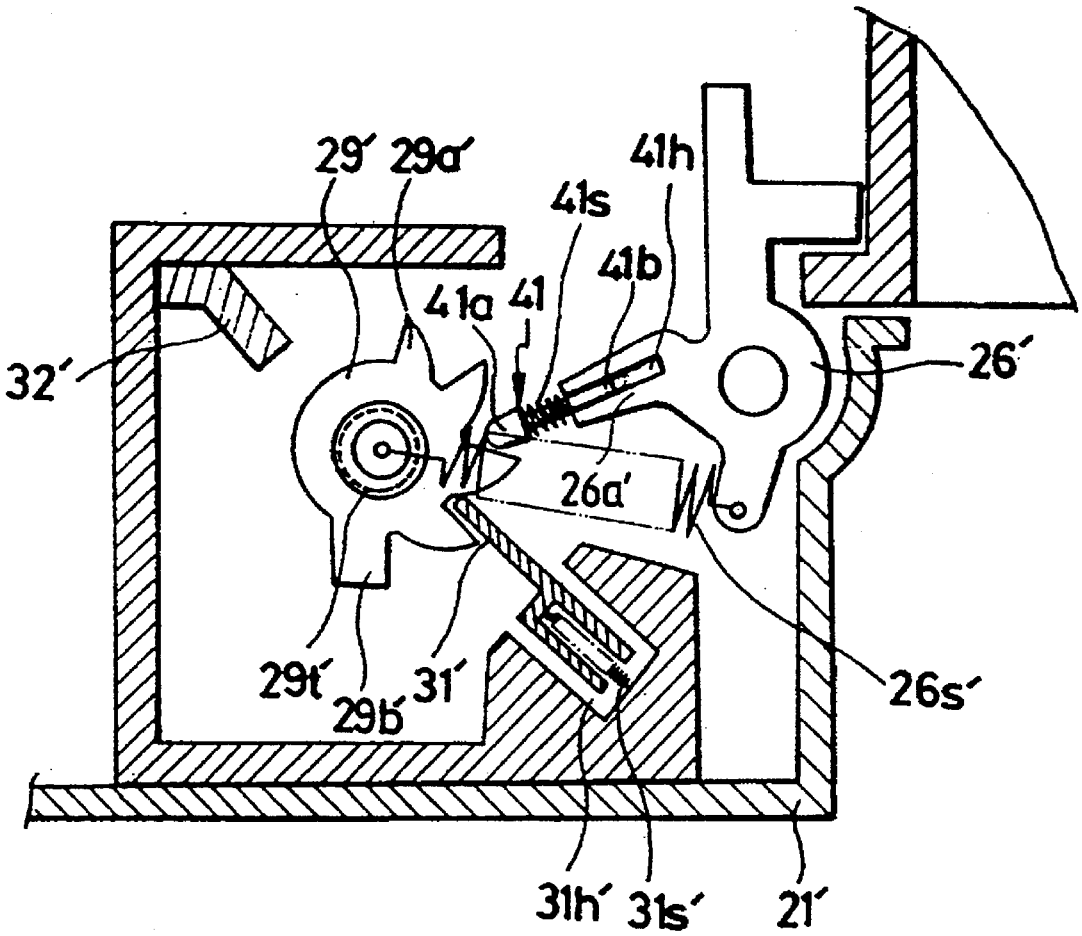
FIG. 4 is a cross-sectional view of another embodiment of the cartridge control device in the developing device as shown in FIG. 2.

FIG. 4 illustrates another embodiment of a cartridge control device for the developing device constructed according to the present invention, in which the mediator 26*a*' of the rotary lever 26' and the frame 21' of a developing device have different structures. As shown in FIG. 4, the mediator 26*a*' of the rotary lever 26' includes a body 41*b* and a groove 41*h* formed therein, a leading end portion of the groove 41*h* that has a contact portion 41 positionable within the interdental spaces of cam (i.e., a ratchet wheel) 29' and directly contacting the teeth 29*a*' of the rotating cam 29'. The contact portion 41 of the mediator includes a head 41*a* in contact with the teeth 29*a*', and the body 41*b* for enabling the contact portion 41 to slide reciprocally along the groove 41*h* by way of a spring 41*s* installed in the body 41*b*. That is, the contact portion 41 is movably or rotatably installed to the leading end portion of rotary lever 26'. Accordingly, the contact portion 41 mediates one tooth of the rotating cam 29 to rotate the rotating cam 29' in the second direction while the rotary lever 26' rotates in the first direction. The contact portion 41 then changes the position by mediating another tooth of the rotating cam 29 to return the rotary lever 26' in the second direction. The frame 21' of the developing device is formed around the body of the rotary lever 26' in order to prevent toner leakage from the toner cartridge.

Figure 5:
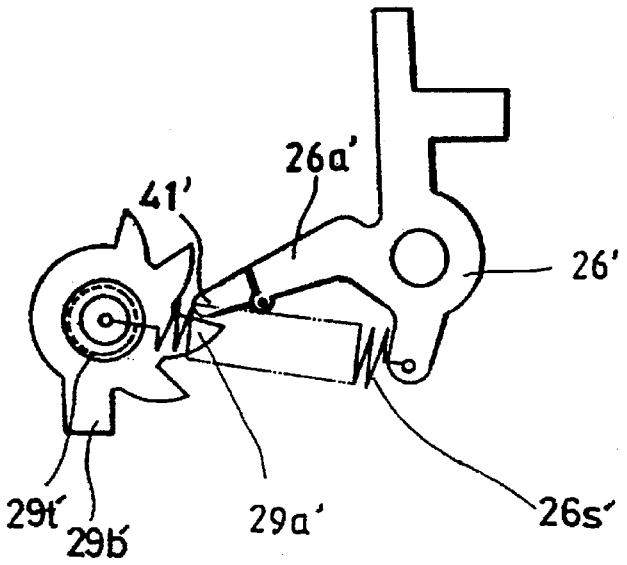
FIG. 5 is a side view of a contact portion of the rotary lever and the rotating cam of another embodiment of the present invention.
Figure 7:
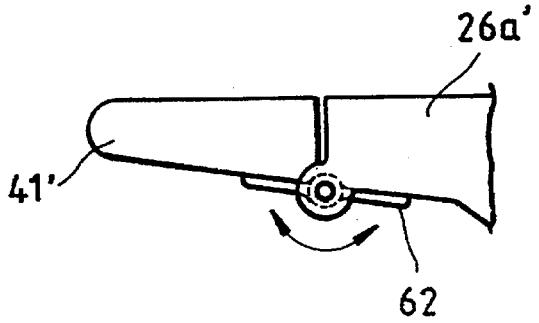
FIG. 7 is a partially enlarged view of the contact portion and a leading end portion of the mediator as shown in FIG. 5.
Figure 6:
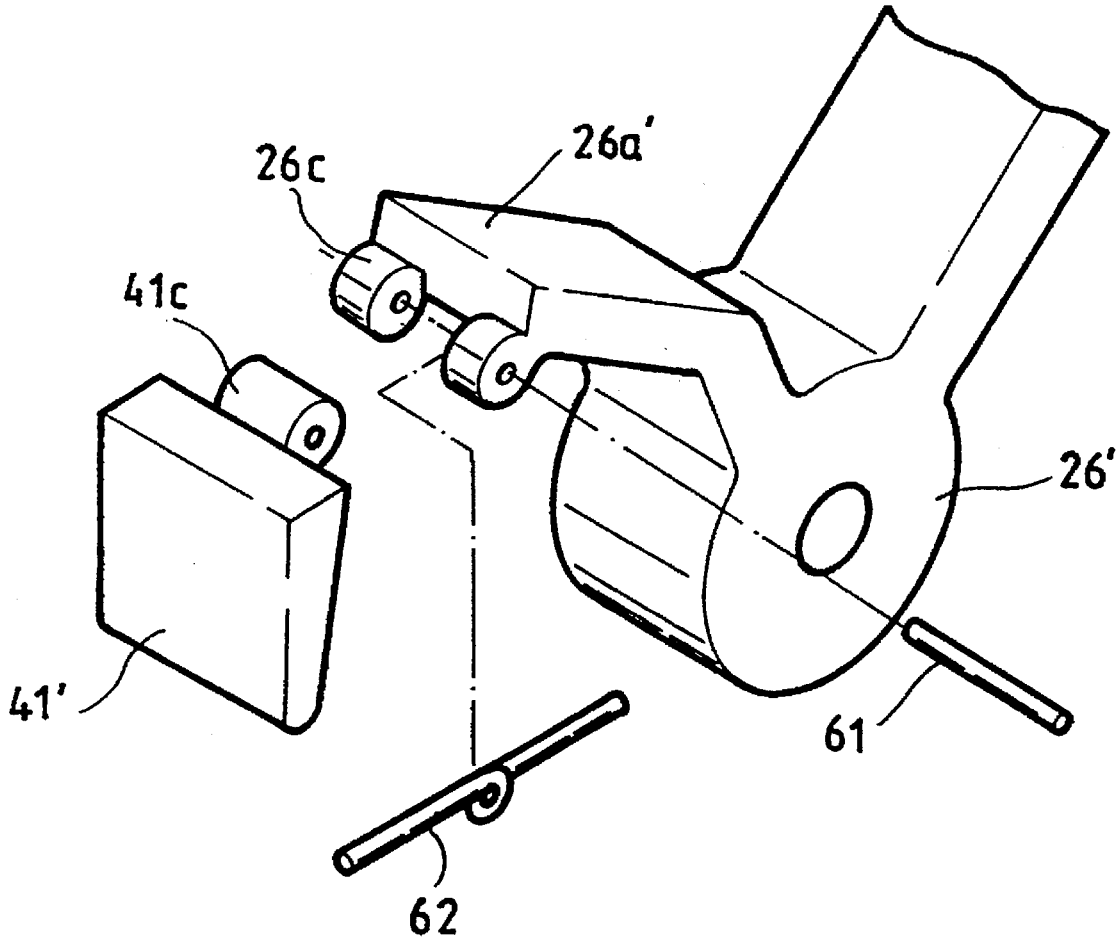
FIG. 6 is an exploded perspective view of the contact portion of the rotary lever and the rotating cam of FIG. 5.

FIGS. 5 through 7 illustrate the contact portion of the mediator 26*a*' of the rotary lever 26' of a developing device according to another embodiment of the present invention. FIG. 5 illustrates a side view of the contact portion between the mediator 26*a*' of the rotary lever 26' and the rotating cam 29' having a plurality of teeth 29*a*' and a protrusion 29*b*' followed the teeth 29*a*', wherein the rotary lever 26' and the rotating cam 29' are elastically connected by the pulling spring 26*s*'. FIG. 6 illustrates a perspective view of the contact portion in a separation state from mediator 26*a*'. FIG. 7 shows an enlarged view of the contact portion of FIG. 5 connected to mediator 26*a*' by way of a spring 62.

As shown in FIG. 6, the leading end portion of the mediator 26*a*' of the rotary lever 26' and the contact portion 41' include hinge connectors 26*c* and 41*c* and are connected by a fixing pin 61. In order for the contact portion 41' to elastically rotate about the hinge connector 26*c* and 41*c*, a spring 62 is inserted between the hinge connector 26*c* on the one end of the mediator 26*a*, and the hinge connector 41*c* of the contact portion 41' as the fixing pin 61 is inserted through the hinge connector 26*a* and 41*c*. This is necessary to ensure more proficient transmission of pushing power of the contact portion 41' to the teeth 29*a*' and provide resiliency of the mediator 26*a* when the rotary lever 26', after being rotated in the first direction, returns to an original state.

Referring now to FIGS. 2 and 3, in which the operation of the cartridge control device and the developing device in the image forming apparatus according to the present invention will be described as follows.

First, the replaceable toner cartridge 30 is placed on the loading portion 21*f*. The user then presses the toner cartridge 30 downward, forcing the rotary lever 26 to move backward to a position represented by a virtual line of FIG. 3 so as to allow the toner cartridge 30 to be loaded on the loading portion 21*f* of the developing device. As the rotary lever 26 is forced to rotate backward in the first direction, the mediator 26*a* interlocked with the rotating cam 29 by way of the teeth 29*a* presses one tooth 29*a* of the rotating cam 29, forcing the rotating cam 29 which receives counterclockwise torsion moment Mt (in the view shown) to rotate in the second direction (i.e., a clockwise direction) by a predetermined angle. While so rotating, the tooth 29*a* of rotating cam 29 presses against the reverse rotation prevention portion 31, forcing the reverse rotation prevention portion 31 to slide backward into the stop loading groove 31*h*. When the rotary lever 26 has moved completely back, the tooth 29*a* of the rotating cam 29 is placed below the reverse rotation prevention portion 31, and the reverse rotation prevention portion 31 slides forward by the elasticity of compression spring 31*s* so as to prevent the rotating cam 29 from rotating in the first direction against the reverse rotation prevention portion 11. Accordingly, the rotating cam 29 is rotated by one tooth at a time.

When the first toner cartridge become empty and must be replaced by a new toner caxtridge, the rotary lever 26 is forced backward to allow the first toner cartridge to be removed from the loading portion 21*f* of the developing device and the new toner cartridge to be loaded on the loading portion 21*f* of the developing device. As the rotary lever 26 moves backward, the mediator 26*a* also forces the rotating cam 29 to rotate by another tooth. Thus, two teeth should be positioned below the reverse rotation prevention portion 31.

When the number of replacement times of a toner cartridges is two, the number of teeth 29*a* below the reverse rotation prevention portion 31 becomes three. When the developing device limits the resupply of toner cartridges by two, in other words, assuming the maximum amount of toner of two replacements of the toner cartridge is equal to the capacity of a container collecting the residue toner, the fixed stopper 32 prohibits rotation of the protrusion 29*b* of the rotating cam 29 so that the rotating cam 29 itself cannot rotate any further. As such, if the rotating cam 29 can not rotate, the rotary lever 26 interlinked with the rotating cam also cannot rotate. Thus the second toner cartridge, once empty, cannot be removed. Accordingly, a third toner cartridge cannot be loaded, which means that the total amount of the toner supplied to the developing unit is limited, and therefore, the total amount of the collected residue toner is also properly limited. Accordingly, the residue toner collected in the waste container is prevented from having an overflow. In the present invention, it is apparent to the person skilled in the art that the number of teeth 29*a* of the rotating cam 29 corresponds to the number of toner cartridge replacements.

In the operation of the caxtridge control device of the embodiment shown in FIG. 4, the entire toner cartridge replacement operation is the same as that shown in FIG. 3. The contact portion 41 of the mediator 26*a* presses teeth 29*a*' of the rotating cam 29' while moving back and forth by the elasticity of the spring 41*s*. When the mediator 26*a*' returns to an original position, the head 41*a* of the mediator 41 can be guided smoothly along the rounded portion of teeth 29*a*'. The entire operation of a contact portion according to another embodiment shown in FIG. 5 is the same as that of FIG. 3. However, more proficient transmission of the pushing power of the contact portion 41' to teeth 29*a*' can be ensured, and when the rotary lever 26' after being rotated in the first direction returns to an original state, the mediation of the teeth 29*a*' and the contact portion 41' is secured.

As described above, the present invention provides a developing device for use in an image forming apparatus having a toner cartridge control device capable of controlling the number of replacement times of a toner cartridge relative to the developing device in order to prevent imbalance between the capacity of a waste toner container which accumulates residual toner and the total amount of toner supplied from the toner cartridge. In the developing device constructed according to the principles of the present invention, a cartridge detachment control device effectively controls the number of the replacement times of the toner cartridge so as to avoid an overflow of the residue toner collected in a reservoir container and thereby preventing imbalance between the total amount of the toner supplied and the capacity of the reservoir container and possible contamination of the image forming apparatus.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments failing within the scope of the appended claims.

What is claimed is:

1. An image forming apparatus comprising:

an image carrier for forming a latent image;

a developing unit having a frame accommodating a toner cartridge, and means for supplying toner from said toner cartridge to the image carrier to develop the latent image, said developing unit having an opening through which toner from said toner cartridge can be supplied to the image carrier;

a waste toner container having a given service life for accumulating waste toner collected from a surface of said image carrier after each image forming operation;

said toner cartridge mounted on said developing unit to cover said opening of said developing unit for supplying toner to said developing unit, a number of toner cartridge replacements being determined by the given service life of said waste toner container to prevent contamination of said image forming apparatus by the overflow of the waste toner contained in said waste toner container; and cartridge control means secured to the frame of said developing unit, for permitting installation of said toner cartridge over the opening of said developing unit when the number of toner cartridge replacements is determined to be within the given service life of said waste toner container, and for prohibiting removal of said toner cartridge mounted on said developing unit from said developing unit when the number of toner cartridge replacements is determined to be at the given service life of said waste toner container, said cartridge control means comprising:

a housing secured to the frame of said developing unit;

a rotary lever secured to said housing and having a locking mechanism at one distal end and a mediator at another distal end, for releasing said locking mechanism for toner cartridge replacement when said rotary lever rotates about a first axis in a first direction, and for enabling said locking mechanism to lock said toner cartridge in place over the opening of said developing unit when said rotary lever rotates about said first axis in a second direction opposite of said first direction;

a rotating cam secured to said housing and interlocked with said mediator of said rotary lever, for counting, as said rotating cam rotates about a second axis of rotation, the number of toner cartridge replacements each time the user exerts force to release the locking mechanism for toner cartridge replacement and to enable said locking mechanism to lock each new toner cartridge in place over the opening of said developing unit; and a cartridge removal stopper secured to said housing, for prohibiting removal of said toner cartridge mounted on said developing unit from said developing unit when the number of toner cartridge replacements corresponds to a counted value determined by the given service life of said waste toner container.

2. The image forming apparatus as claimed in claim 1, wherein said cartridge control means further comprises a reverse-rotation prevention mechanism secured to said housing, for preventing said rotating cam from rotating about said second axis in said first direction.

3. The image forming apparatus as claimed in claim 1, wherein said cartridge control means further comprises a torsion spring installed in said rotating cam for providing torsion moment enabling said rotating cam to rotate in said second direction.

4. The image forming apparatus as claimed in claim 1, wherein said rotating cam is comprised of a plurality of teeth mediated by said mediator of said rotary lever in a predetermined angular interval for representing the number of toner cartridge replacements determined by the given service life of said waste toner container, and a protrusion followed said plurality of teeth for enabling said cartridge removal stopper to prohibit removal of said toner cartridge mounted on said developing unit from said developing unit.

5. The image forming apparatus as claimed in claim 4, wherein said reverse-rotation prevention mechanism is comprised of a compression spring secured in a groove of said housing accommodating said reverse-rotation prevention mechanism for enabling said reverse-rotation prevention mechanism to flexibly slide along each tooth of said rotating cam as said rotating cam rotates in said second direction in response to rotation of said rotary lever by force exerted by the user, and for preventing said rotating cam from rotating axis in said first direction after each time the user exerts force to rotate said rotary lever in one of said first direction and said second direction.

6. The image forming apparatus as claimed in claim 5, wherein said rotating cam and said rotary lever are elastically connected by an elastic pulling string for enabling the mediator of said rotary lever to slide into a next tooth of said rotating cam, as said reverse-rotation prevention mechanism locks in a preceding tooth of said rotating cam after each time said rotary lever rotates in said first direction.

7. The image forming apparatus as claimed in claim 1, further comprised of said mediator of said rotary lever having a head connected to said mediator by elastic bias means for providing elasticity to said mediator, as said mediator resiliently slides along each tooth of said rotating cam.

8. An image forming apparatus, comprising;

an image carrier for forming a latent image;

a developing unit having means for supplying toner to the image carrier to develop the latent image;

a detachable toner cartridge mounted on said developing unit for supplying toner to said developing unit; and cartridge control means secured to said developing unit, for permitting installation of said detachable toner cartridge on said developing unit when a number of toner cartridge replacements does not reach a predetermined value, and for prohibiting removal of said detachable toner cartridge from said developing unit when the number of toner cartridge replacements reaches said predetermined value, said cartridge control means comprising:

a housing secured to said developing unit;

a rotary lever secured to housing and having a locking mechanism at one distal end and a mediator at another distal end, for releasing said locking mechanism for toner cartridge replacement when said rotary lever rotates about a first axis in a first direction, and for enabling said locking mechanism to lock said toner cartridge in place over the opening of said developing unit when said rotary lever rotates about said first axis in a second direction opposite of said first direction;

a rotating cam secured to said housing and interlocked with said mediator of said rotary lever, for counting, as said rotating cam rotates about a second axis, second axis of rotation, the number of toner cartridge replacements each time the user exerts force to release the locking mechanism for toner cartridge replacement and to enable said locking mechanism to lock each new detachable toner cartridge in place over the opening of said developing unit; and a cartridge removal stopper secured to said housing, for prohibiting removal of said detachable toner cartridge mounted on said developing unit from said developing unit when the number of toner cartridge replacements corresponds to a counted value determined by the given service life of said waste toner container.

9. The image forming apparatus as claimed in claim 8, wherein said cartridge control means further comprises a reverse-rotation prevention mechanism secured to said housing, for preventing said rotating cam from rotating about said second axis in said first direction.

10. The image forming apparatus as claimed in claim 9, wherein said cartridge control means further comprises a torsion spring installed in said rotating cam for providing torsion moment enabling said rotating cam to rotate in said second direction.

11. The image forming apparatus as claimed in claim 9, wherein said rotating cam is comprised of a plurality of teeth mediated by said mediator of said rotary lever in a predetermined angular interval for representing the number of toner cartridge replacements determined by the given service life of said waste toner container, and a protrusion followed said plurality of teeth for enabling said cartridge removal stopper to prohibit removal of said detachable toner cartridge mounted on said developing unit from said developing unit.

12. The image forming apparatus as claimed in claim 8, wherein said cartridge control means further comprises a reverse-rotation prevention mechanism secured to said housing, for preventing said rotating cam from rotating about said second axis in said first direction, said reverse-rotation prevention mechanism being comprised of a compression spring secured in a groove of said housing accommodating said reverse-rotation prevention mechanism for enabling said reverse-rotation prevention mechanism to flexibly slide along each tooth of said rotating cam, as said rotating cam rotates in said second direction in response to rotation of said rotary lever, and for preventing said rotating cam from rotating axis in said first direction after each rotation of said rotary lever.

13. The image forming apparatus as claimed in claim 12, wherein said reverse-rotation prevention mechanism is comprised of a compression spring secured in a groove of said housing accommodating said reverse-rotation prevention mechanism for enabling said reverse-rotation prevention mechanism to flexibly slide along each tooth of said rotating cam, as said rotating cam rotates in said second direction in response to rotation of said rotary lever, and for preventing said rotating cam from rotating axis in said first direction after each rotation of said rotary lever.

14. The image forming apparatus as claimed in claim 13, wherein said rotating cam and said rotary lever are elastically connected by an elastic pulling string for enabling the mediator of said rotary lever to slide into a next tooth of said rotating cam, as said reverse-rotation prevention mechanism locks in a preceding tooth of said rotating cam after each time the user exerts force to rotate said rotary lever in said first direction.

15. A developing device in an image forming apparatus having a cartridge loading portion for loading a replaceable toner cartridge, a frame including a hollow portion for receiving toner supplied from said replaceable toner cartridge, a photosensitive drum installed in said hollow portion and having a surface exposed to the exterior of said frame, and a developer roller installed adjacent to said photosensitive drum, said developing device comprising:

a cartridge control device installed on said frame adjacent to said cartridge loading portion, for controlling the installation and removal of said replaceable toner cartridge based upon a number of toner cartridge replacements, said cartridge control device comprising:

cartridge installation and removal means for allowing a user to install said replaceable toner cartridge on said developing device and to remove said replaceable toner cartridge from said developing device, said cartridge installation and removal comprising a rotary lever rotatable in first and second directions, a mediator at one end and a lock mechanism at another end for locking said replaceable toner cartridge on the frame of said developing device;

counter means for counting the number of toner cartridge replacements, said counter means comprising a rotating cam rotatable in said second direction, a plurality of teeth mediated by said mediator in a predetermined angular interval, and a reverse-rotation protrusion for preventing said rotating cam from rotation in said first direction; and cartridge removal protector means for prohibiting removal of said replaceable toner cartridge from said developing device when the number of toner cartridge replacements reaches a predetermined count value.

16. The developing device as claimed in claim 15, further comprised of said mediator having a contact portion in direct contact with each tooth of said rotating cam as said rotary lever rotates in said first direction enabling said mediator to rotate said rotating cam in said second direction, said contact portion being resiliently connected to a leading end portion of said mediator by a spring and a fixing pin.

17. The developing device as claimed in claim 16, wherein said contact portion is connected to said leading end portion of said mediator in a reciprocally sliding manner towards said rotating cam by way of elastic bias means inserted between said contact portion and said mediator for supplying elasticity to the mediator as said mediator resiliently slides along each tooth of said rotating cam when said rotating cam rotates in said second direction.

18. The developing device as claimed in claim 15, wherein said plurality of teeth of said rotating cam correspond to the number of toner cartridge replacements, and said protrusion followed said plurality of teeth enable said cartridge removal protector means to prohibit removal of said replaceable toner cartridge mounted on said developing device from said developing device.

19. A cartridge control device for an image forming apparatus, comprising:

a housing secured to a frame of a developing unit accommodating a toner cartridge having an opening through which toner from said toner cartridge is supplied thereto;

a rotary lever secured to said housing and having a locking mechanism at one distal end and a mediator at another distal end, for releasing said locking mechanism for toner cartridge replacement when said rotary lever rotates about a first axis in a first direction, and for enabling said locking mechanism to lock said toner cartridge in place over the opening of said developing unit when said rotary lever rotates about said first axis in a second direction opposite of said first direction;

a rotating cam secured to said housing and interlocked with said mediator of said rotary lever, for counting the number of toner cartridge replacements each time said locking mechanism is released for toner cartridge replacement thereby enabling said rotating cam to rotate about a second axis of rotation and said locking mechanism to lock each new toner cartridge in place over the opening of said developing unit; and a cartridge removal stopper secured to said housing, for prohibiting removal of said toner cartridge mounted on said developing unit from said developing unit, when the number of toner cartridge replacements reaches a predetermined number.

20. The cartridge control device as claimed in claim 19, further comprising a reverse-rotation prevention mechanism secured to said housing, for preventing said rotating cam from rotating about said second axis in said first direction.

21. The cartridge control device as claimed in claim 19, further comprising a torsion spring installed in said rotating cam to provide torsion moment for enabling said rotating cam to rotate in said second direction.

22. The cartridge control device as claimed in claim 21, further comprised of said rotating cam comprising a plurality of teeth mediated by said mediator of said rotary lever in a predetermined angular interval to represent the number of toner cartridge replacements determined by the given service life of said waste toner container, and a protrusion followed said plurality of teeth for enabling said cartridge removal stopper to prohibit removal of said toner cartridge mounted on said developing unit from said developing unit.

23. The cartridge control device as claimed in claim 22, further comprised of said reverse-rotation prevention mechanism comprising a compression spring secured in a groove of said housing accommodating said reverse-rotation prevention mechanism for enabling said reverse-rotation prevention mechanism to flexibly slide along each tooth of said rotating cam as said rotating cam rotates in said second direction in response to rotation of said rotary lever, and for preventing said rotating cam from rotating axis in said first direction after each time said rotary lever is rotated in one of said first direction and said second direction.

24. The cartridge control device as claimed in claim 23, further comprised of said rotating cam and said rotary lever being elastically connected by an elastic pulling string for enabling the mediator of said rotary lever to slide into a next tooth of said rotating cam, as said reverse-rotation prevention mechanism locks in a preceding tooth of said rotating cam after each time said rotary lever rotates in said first direction.

* * * * *